United States Patent [19]

Long

[11] 4,033,513

[45] July 5, 1977

[54] ELECTROMAGNETICALLY OPERATED VALVE

[75] Inventor: E. David Long, Elmira, N.Y.

[73] Assignee: Allied Chemical Corporation, Morris Township, N.J.

[22] Filed: Nov. 6, 1975

[21] Appl. No.: 629,450

[52] U.S. Cl. ..... 239/585

[51] Int. Cl.[2] ..... B05B 1/30

[58] Field of Search ..... 239/499, 585; 251/140, 251/141; 123/32 EA

[56] References Cited

UNITED STATES PATENTS

| | | | |
|---|---|---|---|
| 1,504,773 | 8/1924 | Marston | 239/585 |
| 1,754,740 | 4/1930 | Clarkson | 239/585 |
| 2,881,980 | 4/1959 | Beck et al. | 239/585 X |
| 2,910,249 | 10/1959 | Gunkel | 239/585 X |
| 3,567,135 | 3/1971 | Gebert | 239/585 |
| 3,592,392 | 7/1971 | Huber | 239/585 |
| 3,705,692 | 12/1972 | Garnier | 239/585 |
| 3,731,881 | 5/1973 | Dixon et al. | 239/585 |
| 3,797,756 | 3/1974 | Voit et al. | 239/585 |

FOREIGN PATENTS OR APPLICATIONS

| | | | |
|---|---|---|---|
| 760,018 | 10/1956 | United Kingdom | 239/499 |

*Primary Examiner*—John J. Love
*Attorney, Agent, or Firm*—Ernest D. Buff; John P. Kirby

[57] ABSTRACT

An electromagnetically operated valve which may be used as a fuel injector in a fuel injection system for an internal combustion engine. The valve includes: a discharge means, a sealing means, a fluid conduit, an electrical conductor, an electromagnetic circuit, a travel limiter and a biasing means. The sealing means intermittently opens and closes the discharge means. The electromagnetic circuit includes: a movable armature, a center pole, a combined housing and outer pole, a coil for magnetizing said electromagnetic circuit in response to said electrical signal and a flux path. The armature is a low mass, dual purpose disc which cooperates with the sealing means. The armature is disposed within and in slideable contact with the housing. The travel limiter limits travel of the armature in an upstream direction and defines a single air gap in the flux path between an upstream face of the armature and a downstream end of the first pole when the armature is in an upstream open position. The armature has a travel distance between its upstream open position and its downstream closed position, which is approximately equal to the single gap in the flux path.

19 Claims, 8 Drawing Figures

ELECTROMAGNETICALLY OPERATED VALVE

BACKGROUND OF THE INVENTION

The present invention relates to an electromagnetically operated valve for delivering predetermined amounts of fluid at predetermined time intervals. The present invention may, for example, be used as a fuel injector in a fuel injection system for a spark-ignited internal combustion engine. Such a fuel injection system provides an intermittent carefully metered flow of fuel to the internal combustion engine, instead of using a carburetor to mix a charge of fuel and air. The fuel injector opens and closes during predetermined time intervals to deliver a predetermined amount of fuel during predetermined time intervals when it is open. Examples of a fuel injection system in which the electromagnetically operated valve of the present invention may be used are disclosed in U.S. patent application Ser. No. 629,421 entitled "Fuel Injection System,"filed concurrently herewith; on Nov. 6, 1975 and U.S. Pat. Nos. 2,980,090; and 3,507,263. Other designs of electromagnetically operated fuel injection valves for internal combustion engines are disclosed in U.S. Pat. Nos. 3,797,756; 3,702,683; 3,680,794; 3,662,987; 3,661,183; 3,567,135; 3,450,353; and 3,412,718.

SUMMARY OF THE INVENTION

An object of the present invention is to provide a highly responsive, electromagnetically operated valve which can quickly open and close. Another object of the present invention is to provide an electrically magnetic operated valve having a more efficient electromagnetic circuit which can exert more force on a movable member opening and closing the valve. Another object of the present invention is to provide an electromagnetically operated valve which is durable, economical to manufacture, has high accuracy, miniature size, can operate at high temperatures and under relatively high pressure. Another object of the present invention is to provide an electromagnetically operated valve adapted for use as a fuel injector in a fuel injection system for an internal combustion engine which achieves: close control of and more complete combustion of the fuel within the engine to reduce emission of pollutants; reduced fuel consumption; and improved engine performance.

The electromagnetically operated valve of the present invention includes: a discharge means, a sealing means, a fluid conduit, an electrical conductor, an electromagnetic circuit, a travel limiter and a biasing means. The sealing means intermittently opens and closes the discharge means. The fluid conduit supplies fluid from a fluid inlet to the discharge means. The electrical conductor supplies an electrical signal to actuate the valve. The electromagnetic circuit includes: a movable armature, a pole having a downstream end, a housing, a coil for magnetizing said electromagnetic circuit in response to said electrical signal and a flux path. The armature has a downstream face and an upstream face. The armature is disposed within and in slideable contact with the housing. The armature is disposed between the pole and the discharge means. The armature has an upstream position, a downstream position and a travel distance between the upstream position and the downstream position. The travel limiter limits travel of the armature in an upstream direction toward a downstream end of the first pole. The travel limiter defines a gag in the flux path between the upstream face of the armature and the downstream end of the first pole when the armature is in the upstream position. The biasing means is disposed within the housing for biasing the armature in its downstream position.

The electromagnetically operated valve of the present invention achieves a high degree of responsiveness by: a design of the armature having a low mass, use of a travel limiter which prevents a problem of astiction, and an arrangement whereby the travel distance of the armature is substantially equal to a single air gap in the electromagnetic circuit, rather than equal to two times the air gap. The electromagnetically operated valve achieves a more efficient electromagnetic circuit which can exert more force on the armature by having a single air gap, rather than two or more air gaps. The electromagnetically operated valve of the present invention is durable, economical to manufacture, miniaturized in size, and highly responsive because it has only one moving part, a combined armature and valve member which forms part of the electromagnetic circuit, which also acts as a part of the valve to open and close the nozzle, and which has a disc shape. The electromagnetically operated valve of the present invention, when used as a fuel injector in a fuel injection system for an internal combustion engine, achieves more complete combustion within the engine to reduce emission of pollutants, achieves reduced fuel consumption and achieves improved engine performance, by delivering the fuel in the form of an atomized spray, rather than in the form of a liquid stream.

DETAILED DESCRIPTION

Figure 1:
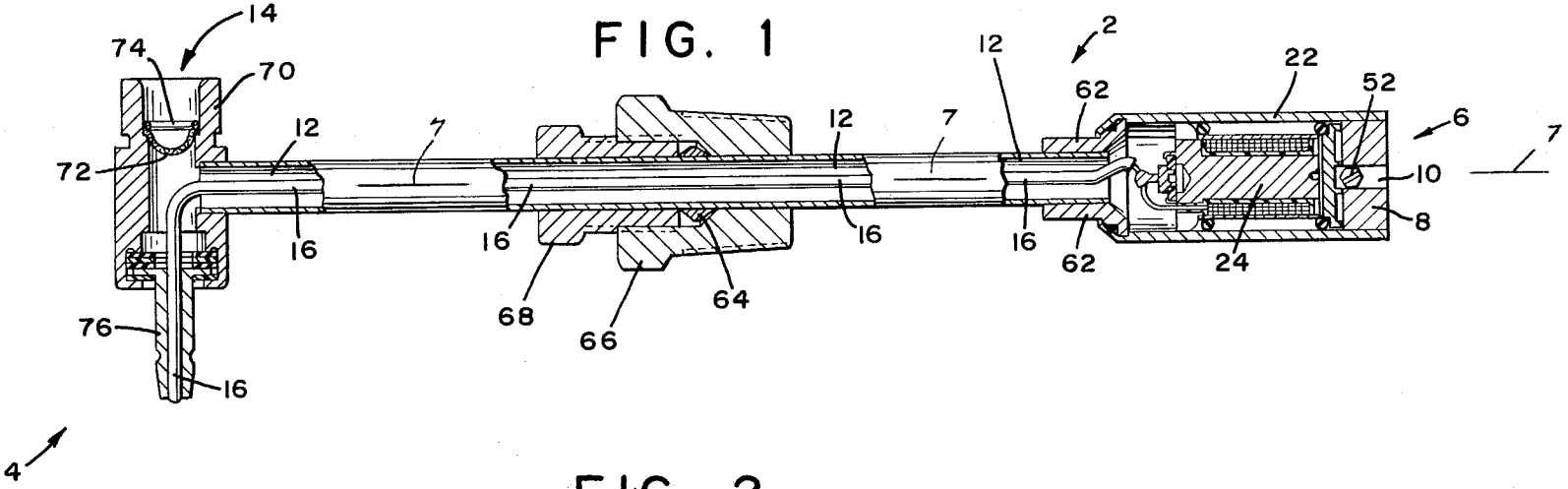
FIG. 1 is a cross-sectional view of the electromagnetically operated valve of the present invention.
Figure 2:
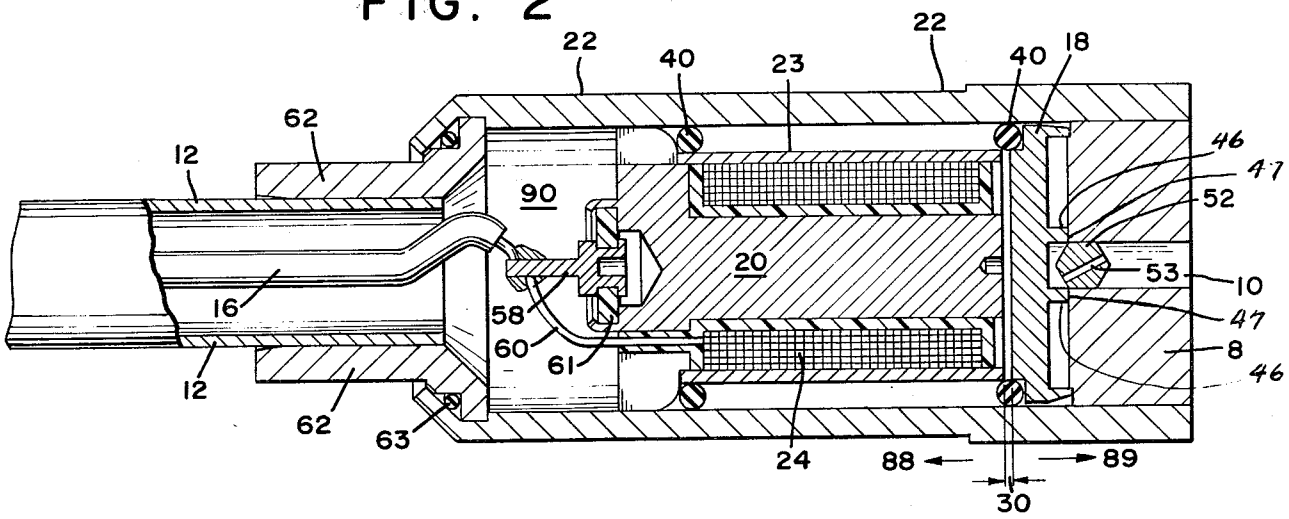
FIG. 2 is an enlarged view of a downstream end of FIG. 1.

Referring to FIG. 1, in a preferred embodiment the electromagnetically operated valve is used as a fuel injector, identified generally by the numeral 2 in a fuel injection system for a spark-ignited internal combustion engine of the Otto type. The fuel injector 2 has an upstream end 4, a downstream end 6, and a longitudinal axis 7. Referring to FIGS. 1 and 2, the fuel injector includes: a discharge means; a fuel conduit; an electrical conductor; an electromagnetic circuit; a travel limiter; a biasing means; and a sealing means.

The discharge means, such as a metering nozzle 8, is located at the downstream end 6 of the injector 2 and has a longitudinally extending, centrally disposed orifice 10 parallel to, and preferably coincident with, the longitudinal axis 7 of the injector 2 for delivering a fluid, such as fuel, i.e. gasoline, to the engine. The nozzle 8 and orifice 10 have an upstream end and a downstream end. The fuel conduit 12 extends along the length of the fuel injector 2 for conducting fuel under pressure from a fuel inlet means 14 to the nozzle 8. The electrical conductor, such as an electrical wire 16, extends along the length of the injector 2 for supplying an electrical signal, i.e. an electrical pulse of predetermined duration at pedetermined time intervals, to energize the electromagnetic circuit and actuate the injector 2. The electromagnetic circuit includes: an armature 18, a center first pole 20, a housing 22, and a coil 24 for magnetizing the electromagnetic circuit, and a flux path.

Figure 3:
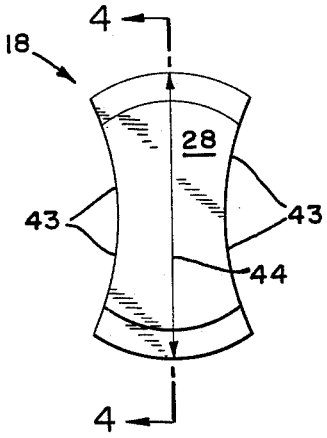
FIG. 3 is a front elevational view of an upstream face of an armature which is a component of the valve shown in FIGS. 1 and 2.
Figure 4:
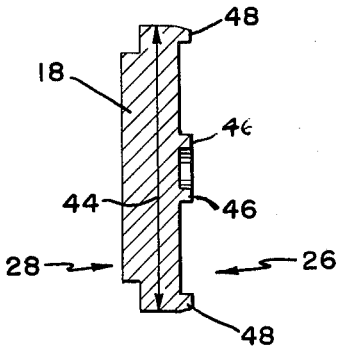
FIG. 4 is a cross-sectional view of FIG. 3 along the lines 4—4.
Figure 5:
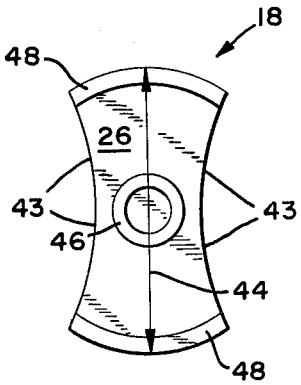
FIG. 5 is a front elevational view of a downstream face of the armature shown in FIGS. 3 and 4.

Referring to FIGS. 3—5, the armature 18 has a downstream face 26 and an upstream face 28. Referring to FIG. 2, the armature 18 is disposed within the housing 22 and in sidable contact with the housing 22. The housing 22 is a combined, dual purpose, unitary housing and outer second pole made of magnetizable material. The housing-outer pole 22 encloses the armature 18, travel limiter 23, coil 24 and center pole 20. The housing-outer pole 22 also forms part of electromagnetic circuit. The armature 18 is disposed outside of the first pole 20 and between the first pole 20 and the nozzle 8. The armature 18 is the sole moving component within the injector 2 and has an upstream position, a downstream position shown in FIG. 2, and predetermined, intermittent, unrestrained, free-floating, reciprocating motion parallel to the longitudinal axis 7 of the injector 2 over a predetermined fixed travel distance 30 between the upstream position and the downstream position.

Figure 7:
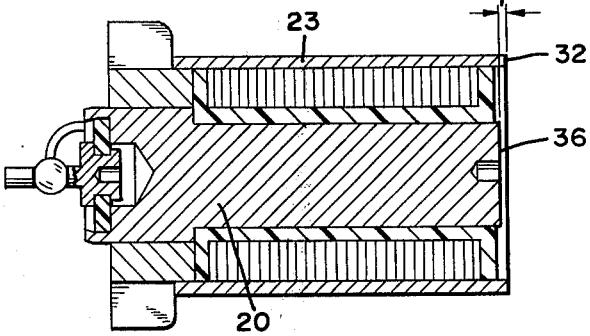
FIG. 7 is a view of a portion of FIG. 2.

Referring to FIG. 7, a downstream end 32 of the travel limiter 23 limits movement of the armature 18 in an upstream direction toward its upsteam position and toward a downstream end 36 of the first pole 20. The downstream end 32 of the travel limiting member 23, preferable made of a non-magnetizable material, defines a residual gap 38 (exaggerated in scale in FIG. 7) in the flux path between the upstream face 28 of the armature 18 and the downstream end 36 of the first pole 20 when the upstream face 28 of the armature 18 is in its upstream position, that is, in contact with the downstream end 32 of the travel limiter 23. There is a single air gap which is equal to the length of the residual air gap 38 plus the travel distance 30 of the armature 18; the significance of which will be described subsequently herein. Referring to FIG. 2, the biasing means, such as a spiral return spring 40, biases the armature 18 in its downstream position. The armature 18 is really a combined, dual purpose, unitary, armature 18-valve member. The armature 18 forms part of the electromagnetic circuit and part of an electromagnetically operated vale. In its downstream position (FIG. 2), at least a portion of the downstream face 26 of the armature 18 is in contact with the upsteam face 42 of the nozzle 18.

The mass of the armature 18 has been minimized as much as possible. Referring to FIGS. 3–5, the armature 18 is a disc made of a magnetic material and having a substantially circular outer circumference, cut-out sections 43 along at least one and preferably two portions of the outer circumference for allowing passage of fuel and, a major diameter 44 extending between opposing sides of the outer circumference. The armature diameter 44 approaches the dimension of an interior diameter of the housing 22. As a result, the circumference of the armature 18 has a close fitting, sliding contact with interior walls of the housing 22. The armature 18 has a thickness not exceeding one-half of the armature diameter 44 and preferably not exceeding one-quarter of the armature diameter 44. As a result, the armature 18 has relatively small dimensions and is light in weight, thereby allowing the armature 18 to be moved by a comparatively small force generated by the electromagnetic circuit, enabling the armature 18 to have a short time response, i.e., to be highly responsive to the electromagnetic circuit in quickly opening and closing the orifice 10.

Figure 6:
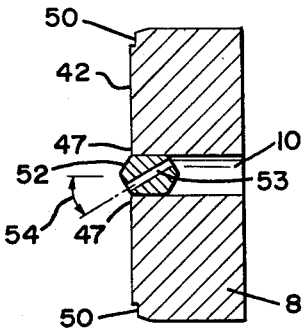
FIG. 6 is an enlarged view of the nozzle shown at the downstream end of FIG. 1.

Referring to FIGS. 4–6, the sealing means for sealing the orifice 10 includes an annular ridge 46 disposed between the downstream face 26 of the armature 18 (FIGS. 4 and 5) and the upstream face 42 (FIG. 6) of the nozzle 8. The annular ridge 46 has a circumference and a diameter which are slightly larger than the circumference and the diameter of the upstream end of the orifice 10 in order that the annular ridge 46 encircles the upstream end of the orifice 10. The annular ridge 46 preferably is disposed on the downstream face 26 of the armature 18. In the alternative, the annular ridge 46 could be disposed on the upstream end 42 of the nozzle 8 surrounding the orifice 10. When the armature 18 is in its downstream closed position, the annular ridge 46 completely encircles a valve seat 47 on the upstream end of the orifice 10 and closes the orifice 10, preventing fuel from entering the upstream end of the orifice 10.

The sealing means includes: the valve seat 47, and the annular ridge 46. There are annular outer lands 48 and a circular undercut portion 50 which are disposed between the downstream face 26 of the armature 18 and the upstream face 42 (FIG. 6) of the nozzle 8. Preferably, the valve seat 47 is on the upstream face of 42 (FIG. 6) of the nozzle 8 surrounding the upstream end of the orifice 10. Preferably, the outer lands 48 are disposed on the downstream face 26 of the armature 18 and the undercut portion 50 is disposed on the upstream face 42 of the nozzle 8. The circumference of the outer lands 48 is substantially equal to the circumference of the undercut portion 50 so that the outer lands 48 mate with and fit into the undercut portion 50. Preferably, the outer lands 48 are disposed on the outer circumference of the downstream face 26 of the armature 18 and the undercut portion 50 is disposed on the outer circumference of the upstream face 42 of the nozzle 8. Alternatively, the outer lands 48 could be disposed on the outer cicumference of the upstream face 42 of the nozzle 8 and the undercut portion 50 disposed on the outer circumference of the downstream face 26 of the armature 18.

The height of the annular ridge 46 is substantially equal to the height of the annular lands 48, in a direction parallel to the longitudinal axis of the injector 2. When the armature 18 moves in a downstream direction to its downstream closed position, the annular ridge 46 makes contact with the upstream face 42 of the nozzle 8 before the outer lands 48 can make contact with the upstream face 42 of the nozzle 8, as a result of the undercut portion 50. This arrangement insures an effective seal and closure of the orifice 10.

The travel limiter 23 maintains a residual air gap 38 between the upstream face of the armature 18 and the downstream end 36 of the first pole 20 when the armature 18 is in its upstream open position. The travel limiter 23 also prevents magnetic and fluid astiction between the upstream face 28 of the armature 18 and the flat surface at the downstream end 36 of the first pole 20. Such prevention of astiction allows the upstream face 28 of the armature 18 to be released from contact with the downstream end 32 of the travel limited 23 easier and with less force than the upstream face 28 of the armature 18 could be released if it were in contact with the flat surface at the downstream end 36 of the first pole 20. The travel limiter 23 is preferably a tubular member disposed coaxially around the coil 24.

Referring to FIGS. 1, 2 and 6, a spray member 52 is preferably disposed in the orifice 10 for at least partially atomizing the fuel, and preferably completely atomizing the fuel, into a spray for delivery of the fuel in the form of a spray to the engine. Atomizing refers to breakup of the fuel into fine particles to accelerate evaporation of the fuel to facilitate mixing with air for improved combustion which reduces emission of pollutants from the engine, reduces fuel consumption and improves engine performance. Referring to FIG. 6, the spray member 52 has an interior bore 53 having a longitudinal axis. The orifice 10 also has a longitudinal axis. The longitudinal axis of the bore 53 is disposed at an angle 54 with reference to the longitudinal axis of the orifice 10 for achieving impact by the fuel against an interior wall of the orifice 10 after the fuel passes through the bore 53 of the spray member 52. Such impact produces atomization of the fuel into a spray. The angle 54 may be within the range from 5° to 80°, and preferably within the range from 30° to 45°. Alternatively, instead of a bore 53 extendng at an angle to the orifice 10, the spray member 52 may use a helical bore. The helical bore could be arranged around the outer circumference of the spray member 52. Preferably, the breakup of the fuel flowing through the nozzle 8 into a spray is enhanced by a high velocity of the fuel, which in turn is enhanced by a high pressure maintained with the fuel injector 2. For example, the fuel may be supplied to the injector 2 under a pressure of about 100 pounds per square inch gage. In preferred embodiments using a spray member 52, the bore 53 becomes the operative orifice for the nozzle 8, rather than the orifice 10. In embodiments not using a spray member 52, the orifice 10 is the operative orifice and should be smaller in diameter than if a spray member 52 were used.

The significance of having a single air gap, as compared to prior art electromagnetic circuits which have commonly two or more air gaps, is that the efficiency and the force applied by the electromagnetic circuit to the armature 18 is markedly increased. For example, in U.S. Pat. No. 3,412,718 there are multiple air gaps in the electromagnetic circuit, i.e., between inner pole 12 and flapper valve 26, and between the outer pole and the flapper valve 26, with the result that the sum of the series air gaps is substantially equal to twice the travel distance of the flapper valve 26. Referring to FIGS. 2 and 7 of the present invention, a typical line of flux in the flux path of the electromagnetic circuit of the present invention runs through the first pole 20, across the residual air gap 38, across the travel distance 30, through the 18, through the housing 22 which acts as a second pole of the electromagnetic circuit and back to the first pole 20. The amount of flux is inversely proportional to the air gap, as shown by the following known formula:

$$B = (N \times I \times 1.26)/L$$

where $L$ is the length of the total series air gaps, that is, residual air gap 38 plus travel distance 30; $B$ is the amount of flux, that is, the amount of flux lines per unit cross-sectional area; $N$ is the number of turns in the coil; $I$ is the amperage of electricity in the circuit; and 1.26 is a constant. Since there is only one air gap in the present invention, rather than two or more air gaps as in prior art electromagnetic circuits, the amount of flux $B$ in the present invention is approximately doubled. The amount of flux $B$ is doubled because the total length of the series air gaps $L$ in the present invention is about half or less than the length of the total series air gaps in prior act electromagnetic circuits. This is because the total length of the series air gaps $L$ in the present invention is approximately equal to the travel distance 30 plus the residual air 38, rather than two or more times the travel distance as is prior air electromagnetics circuits. The force exerted by the electromagnetic circuit upon the armature 18 is proportional to the square of the amount of flux B, as shown by the following known formula:

$$F = (B^2 \times A)/8\pi$$

where $F$ is the electromagnetic force exerted (in dynes), $B$ is the amount of flux, and $A$ is the cross-sectional area of the air gap. As a result, the electromagnetic circuit of the present invention exerts significantly more force on the armature 18 than prior art electromagnetic circuits approximately four times as much force; when all other variables are the same. Having once passed through the total series air gap, the lines of force in the present invention do not pass through the total series air gap a second time. There are no other air gaps in the electromagnetic circuit. For example, there is no gap between the armature 18 and the housing 22. There is only a close sliding fit between the outer circumference of the armature 18 and the interior wall of the housing 22. The total series air gap is between the downstream end 36 and the upstream face 28. The total series air gap is a single gap, having two components (the residual air gap 38 and the travel distance 30), not two or more separate gaps remote from one another. The significance of having the travel distance 30 plus the residual air gap 38 substantially equal to the length of the total series air gap is that the amount of flux is substantially increased, thereby increasing electromagnetic force F.

The nozzel 8 has a circular shape and a circumference dimensioned to fit within the housing 22. The coil 24 is disposed on a tubular bobbin 56 having flanges at each end. The first pole 20 is centrally and axially disposed within the bobbin 56. The first pole 20 has a flange 57 at its upstream end in contact with the housing-outer pole 22. The flange 57 has holes to allow passage of fuel. The bobbin 56 is centrally and axially disposed within the coil 24. The coil 24 is centrally and axially disposed within the travel limiter 23. The travel limiter 23 is a tubular member, centrally and axially disposed within the housing 22. The electrical wire 16 is connected to the coil 24 by a first terminal 58 and a lead wire 60. The electrical wire 16 is insulated from the first pole by an insulator 61. Referring to FIGS. 1 and 2, the fuel conduit 12 is a tubular member connected to an upstream end of the housing 22 by an adapter 62. The fuel conduit 12 and the housing 22 are disposed parallel to the longitudinal axis 7 of the injector 2. An "O" 63, is provided between the upstream end of the housing 22 and a downstream end of the adapter 62. The electrical wire 16 extends centrally and axially within the fuel conduit 12 along the length of the fuel conduit 12.

Referring to FIG. 1, a mounting means is provided around the fuel conduit 12 for mounting the fuel conduit 12 and injector 2, to the engine, such as to the intake or induction manifold of the engine. The mounting means is located at the approximate middle portion of the fuel injector 3 and the fuel conduit 12 between the upstream end 4 and the downstream end 6 of the fuel injector 2. The mounting means includes: a sleeve 64, an adapter 66, and a male nut 68.

Figure 8:
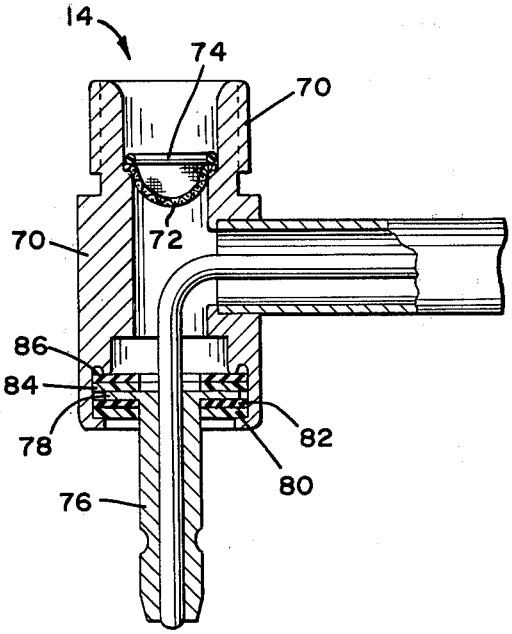
FIG. 8 is an enlarged view of an upstrem end of FIG. 1.

Referring to FIGS. 1 and 8, the fuel inlet means 14 includes a fitting 70, an interior screen 72 disposed within the fitting 70 and a retaining ring 74 for holding the screen 72 within the fitting 70. The screen 72 is intended to filter undesired particles from the fuel entering the inlet means 14. The screen 72 is not the main filtering device for fuel being supplied to the engine. The fitting 70 is attached to the upstream end of the fuel conduit 12, such as by welding.

A second terminal 76 is provided for connecting the electrical wire 16 to the fitting 70. The second terminal has a flange 78. A first non-compressible washer 80 and a first compressible washer 82 are disposed below the flange 78. A second non-compressible washer 84 and a second compressible washer 86 are disposed above the flange 78. The first compressible washer 82 is disposed between the flange 78 and the first non-compressible washer 80. The second non-compressible washer 84 is disposed between the second compressible washer 86 and the flange 78. The first and second non-compressible washers 80 and 84 may be made of a material such as nylon. The rist and second compressible washers 82 and 86 may be made of a material such as rubber. The non-compressible washers 80 and 84 keep the second terminal 76 centered and prevent shorting of the electrical wire 16. The compressible washers 82 and 86 allow crimping to achieve a tight mechanical seal to prevent leakage of the fuel.

In operation, the armature 18 is normally closed and opens only for short intervals of time. When the coil 24 of the electromagnetic circuit is energized, the armature 18 is moved from its downstream closed position (FIG. 2) to its upstream open position by the electromagnetic attraction of the coil 24. The armature 18 moves to its upstream open position in an upstream direction, indicated by arrow 88 in FIG. 2, against the force of the return spring 40 and against the flow of fuel into the fuel injector 2. When the coil 24 is de-energized, the spring 40 pushes the armature 18 in a downstream direction, indicated by arrow 89 in FIG. 2, to its downstream closed position in which the armature 18 acts as a valve member closing the orifice 10 of the nozzle 8. In its upstream open position, the armature 18 moves away from the valve seat 47, thereby opening the nozzle 8 and allowing communication from the fuel injector 2 through the orifice 10 into the engine. The flow path of fuel passes from the fuel conduit 12 through an accumulation chamber 90, then through holes in flange 57, then around the outside of the travel limiter 23 where the return spring 40 is located, then through the cut-out sections 43 of the armature 18 and then through the orifice 10 when the orifice 10 is opened by the armature 18.

What is claimed is:

1. An electromagnetically operated valve, comprising:

a discharge means;

a sealing means for intermittently opening and closing said discharge means;

a fluid conduit for supplying fluid from a fluid inlet to said discharge means;

an electrical conductor for supplying an electrical signal to actuate said valve;

an electromagnet circuit comprising: an armature, a pole having a downstream end, a housing, a coil means for magnetizing said electromagnetic circuit in response to said electrical signal, and a flux path, said armature being a disc having a major diameter and a thickness substantially less than said major diameter, said disc having an upstream face and a downstream face and being slidably disposed at a terminal end of said housing adjacent to and between said pole and said discharge means, said armature having an upstream position, a downstream position, a travel distance between said upstream position and said downstream position, and a substantially close fitting relationship with said housing;

said armature, said pole, and said housing cooperating to define a single series air gap in said flux path between said upstream face of said armature and said downstream end of said first pole;

a travel limiter disposed coaxially around said coil for limiting travel of said armature in an upstream direction toward a downstream end of said pole, said travel limiter maintaining a residual air gap between said upstream face of said disc and said downstream end of said pole when said armature is in said upstream position, said residual air gap forming part of said single series air gap; and a biasing means disposed within said housing for biasing said armature in its downstream position.

2. The electromagnetically operated valve according to claim 1 wherein said disc has a substantially circular outer circumference, and a cut-out section on a portion of said circumference for allowing passage of fluid.

3. The electromagnetically operated valve according to claim 2 wherein said disc is the sole movable member within said electromagnetically operated valve, said disc having a thickness less than one-half of its major diameter and being movable by a small force exerted thereon by said electromagnetic circuit.

4. The electromagnetically operated valve according to claim 1 wherein said sealing means comprises an annular ridge connected to said downstream face of said armature for effecting sealing contact with said upstream face of said discharge means.

5. The electromagnetically operated valve according to claim 1 wherein said travel limiter is a tubular member and said single series air gap comprises said residual gap and said travel distance of said armature.

6. A fuel injector for an internal combustion engine, comprising:

a discharge means having an orifice for delivering fuel to said engine, said orifice having a downstream end and an upsteam end;

a sealing means for intermittently opening and closing said upstream end of said orifice;

a fuel conduit for supplying fuel under pressure from a fuel inlet to said discharge means;

an electrical conductor for supplying an electrical pulse of predetermined duration at pedetermined time intervals to actuate said valve;

an intermittently energized electromagnetic circuit comprising a movable armature, a center pole having a downstream end, a housing having interior walls and a terminal end, a coil means for magnetizing said electromagnetic circuit in response to said electrical pulse; and a flux path having a single total series gap; said armature being a disc having a major diameter and a thickness substantially less than said major diameter, said disc having a downsteam face and an upstream face and being disposed within said housing and in slidable contact with interior walls at said terminal end thereof, said armature disposed outside of said center pole, adjacent to and between said center pole and said discharge means, said armature having an upsteam position wherein said orifice of said discharge means is open, a downstream position wherein said orifice of said discharge means is closed, and motion over a travel distance between said upstream position and said downstream position;

a travel limiter disposed coaxially around said coil for limiting travel of said armature in an upstream direction toward a downstream end of said center pole, said travel limiter defining a residual gap in said flux path between said upstream face of said disc and said downstream end of said center pole when said disc is in said upstream position, said residual gap forming part of said single series gap, said travel distance of said armature substantially equal to said total series gap in said flux path; and a biasing means disposed within said housing for biasing said armature in its downstream position.

7. The fuel injector according to claim 6 wherein said disc has a substantially circular outer circumference, a portion of said circumference containing at least one cut-out section for allowing passage of fluid, a major diameter of said disc extending between opposing sides of said outer circumference of said disc, said housing having an interior wall and an interior diameter, said major diameter of said disc approaching the dimension of a diameter of said housing, said circumference of said disc having a sliding contact with said interior wall of said housing.

8. The fuel injector according to claim 6 wherein said sealing means comprises an annular ridge disposed on said downstream face of said armature between said downstream face of said armature and said upstream face of said discharge means.

9. A fuel injector for an internal combustion engine, comprising:

a metering nozzle having an orifice for delivering fuel to said engine and a valve seat;

a fuel conduit for supplying fuel to said nozzle;

an electrical conductor for supplying an electrical signal for actuating said injector;

an electromagnetic circuit comprising: a first pole, a combined housing-second pole, a combined armature-valve member, and a coil means for energizing said pulses;

said combined armature-valve member forming part of an electromagnetic valve and forming part of said electromagnetic circuit, said armature-valve member being a disc having a major diameter and a thickness substantially less than said major diameter, said disc having an upstream face, a downstream face, and motion over a travel distance between a downstream closed position and an upstream open position, said disc in said downstream position cooperating with said valve seat to open said orifice of said nozzle, said disc in said upstream position opening said orifice of said nozzle, said disc being disposed within said combined housing-second pole in slideable contact therewith and between said first pole and said nozzle;

said electromagnetic circuit having a flux path and a single gap in said flux path between a downstream end of said first pole and said upstream face of said disc, said single gap comprised of a residual gap and said travel distance of said armature;

a travel limiter disposed coaxially around said coil for limiting movement of said armature-valve member in an upstream direction toward a downstream end of said first pole, said travel maintaining said residual gap between said upstream face of said disc and said downstream end of said first pole when said disc is in said open position, said residual gap forming part of said total series gap; and a biasing means for biasing said armature-valve member in its downsteam closed position.

10. The fuel injector according to claim 9 wherein said nozzle further comprises a spray member disposed within said orifice of said nozzle for producing at least partial atomization of said fuel passing through said orifice.

11. The fuel injector according to claim 10 wherein said spray member has an interior bore having a longitudinal axis, said orifice has an interior wall and a longitudinal axis, said longitudinal axis of said bore is disposed at an angle with reference to said longitudinal axis of said orifice for achieving impact by said fuel against said interior wall of said orifice.

12. The fuel injector according to claim 9 wherein said disc has a substantially circular outer circumference, a portion of said circumference containing a cut-out section for allowing passage of fluid therethrough, said major diameter of sad disc extending between opposing sides of said outer circumference thereof, said housing-second pole having an interior wall and an interior diameter of said disc approaching the dimension of said diameter of said housing-second pole, and said circumference of said disc having sliding contact with said interior wall of said housing-second pole.

13. The fuel injector according to claim 9 wherein said disc has a thickness less than one-half said major diameter of said disc, said disc being the sole movable member within said fuel injector whereby said armature-valve member is movable by a small force exerted thereon by aid electomagnetic circuit

14. The fuel injector according to claim 9 wherein: said sealing means comprises an annular ridge connected to said downstream face of said armature-valve member for effecting sealing contact with an upstream face of said discharge means.

15. The fuel injector according to claim 14 wherein said nozzle has an upstrem end and said annular ridge is disposed on said upstream end of said nozzle.

16. An electromagnetically operated valve comprising:

a housing;

a metering nozzle having an orifice for delivering a fluid, said nozzle and orifice having a downstream end and an upstream end, aid upstream end of said nozzle having a valve seat;

a fluid conduit for supplying a stream of fluid under pressure from a fluid inlet means to said nozzle;

means for supplying an electrical signal for actuating said valve;

a combined, unitary armature-valve member for opening and closing said valve seat and forming part of an electromagnetic circuit, said armature-valve member being a disc having a major diameter and a thickness substantially less than said major diameter, said disc having an upstream face, a downstream face, and predetermined, intermittent, reciprocating motion over a predetermined travel distance between a normally closed downstream position and an intermittently open upstream position, said disc in said downstream position cooperating with said valve seat at a terminal end of said housing to close said orifice of said nozzle, said armature-valve member in said upstream position openning said orifice of said nozzle for allowing passage of fluid through said orifice;

said electromagnetic circuit comprising a center pole, a combined, unitary housing-outer pole, said armature-valve member, and a coil means for energizing said circuit in response to said electrical signal;

said armature-valve member disposed within said housing-outer pole, said armature-valve in slideable contact with said combined housing-outer pole, said armature-valve member disposed outside of said housing-outer pole and between said center pole and said nozzle.

said electromagnetic circuit having a flux path and an air gap in said flux path between a downstream end of said center pole and said upstream face of said disc, said length of said air gap substantially equal to said travel distance of said disc between said downstream position of said disc and said upstream position of said disc;

a travel limiter for limiting movement of said disc in an upstream direction toward a downstream end of said center pole, said travel limiter defining a residual air gap between said upstream face of said disc and said downstream end of said center pole when said disc is in said open positon, said residual air gap forming part of said air gap; and a biasing means disposed within said outer pole-housing biasing said disc toward its downstream closed position.

17. The electromagnetically operated valve according to claim 6 and further comprising means for mounting said valve in an internal combustion engine.

18. The electromagnetically operated valve according to claim 17 and further comprisng means for connecting said electrical conductor to an external source of an electrical signal.

19. The electromagnetically operated valve according to claim 18 wherein said means for connecting said electrical conductor to said external source of an electrical signal comprises an electrical terminal having a flange, a first non-compressible washer, a first compressible washer, a second non-compressible washer, and a second compresible washer.

* * * * *

UNITED STATES PATENT OFFICE
CERTIFICATE OF CORRECTION

Patent No. 4,033,513 Dated July 5, 1977

Inventor(s) E. David Long

It is certified that error appears in the above-identified patent and that said Letters Patent are hereby corrected as shown below:

Column 1, line 19, after "in" insert --my--.

line 21, after "1975" insert --;--.
line 24, after "Nos." insert --:--.

Column 2, line 49, "upstrem" should read --upstream--.

Column 3, line 8, "pedetermined" should read --predetermined--.
line 17, "sidable" should read --slidable--.
line 54, "vale" should read --valve--.

Column 5, line 62, after "the" insert --armature--.

Column 7, line 11, "3" should read --2--.
line 36, "rist" should read --first--.

Column 9, line 5, after "comprising" insert --:--.
line 13, "steam face" should read --stream face--.
line 62, "pulses" should read --poles--.

UNITED STATES PATENT OFFICE

CERTIFICATE OF CORRECTION

Patent No. 4,033,513 Dated July 5, 1977

Inventor(s) E. David Long

It is certified that error appears in the above-identified patent and that said Letters Patent are hereby corrected as shown below:

Column 10, line 42, "sad" should read --said--.
line 55, "aid" should read --said--.

Column 11, line 1, "aid" should read --said--.
line 23, "openning" should read --opening--.

Column 12, line 15, "positon" should read --position--.
line 21, "6" should read --16--.

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*